United States Patent [19]

Rothrock

[11] 4,101,357

[45] Jul. 18, 1978

[54] METHOD OF SPLICING MOTION PICTURE SOUND FILM

[76] Inventor: Arthur A. Rothrock, 8112 N. Druid St., Portland, Oreg. 97203

[21] Appl. No.: 794,656

[22] Filed: May 6, 1977

Related U.S. Application Data

[62] Division of Ser. No. 749,746, Dec. 13, 1976, Pat. No. 4,052,247.

[51] Int. Cl.[2] ..... B31F 5/06

[52] U.S. Cl. ..... 156/159; 156/266; 156/304; 242/59

[58] Field of Search ..... 156/157, 159, 266, 304, 156/505, 506; 242/58.1, 58.5, 59

[56] References Cited

U.S. PATENT DOCUMENTS

| | | | |
|---|---|---|---|
| 2,021,016 | 11/1935 | Narath | 156/159 |
| 2,049,523 | 8/1936 | Sponable | 156/304 |
| 2,930,427 | 3/1960 | Fillman et al. | 242/58.1 |
| 3,142,607 | 7/1964 | Scherer | 156/506 |

*Primary Examiner*—William A. Powell
*Assistant Examiner*—Jerome W. Massie
*Attorney, Agent, or Firm*—Oliver D. Olson

[57] ABSTRACT

Motion picture sound film is spliced by cutting the film transversely between the adjacent picture frames, then longitudinally forward between the picture frames and sound stripe to the end point at which the sound relates to the first picture frame adjacent the transverse cut, and then transversely across the sound stripe at said end point. A similar cutting is made at the opposite end of a length of the film to be removed, whereby to provide a pair of mating ends on film portions to be joined. These mating ends are arranged with their mating edges in abutment, the forwardly extended sound stripe of the first cutting fitting into the notch formed by the removal of sound stripe in the second cutting, and the picture frames adjacent the transverse cut being in edge-to-edge abutment. Pressure sensitive transparent tape then is applied across the abutting transverse and longitudinal edges to secure the splice.

5 Claims, 14 Drawing Figures

METHOD OF SPLICING MOTION PICTURE SOUND FILM

This is a division, of application Ser. No. 749,746, filed 13 Dec. 1976, now U.S. Pat. No. 405224.

BACKGROUND OF THE INVENTION

This invention relates to motion picture sound film, and more particularly to novel method by which to splice motion picture sound film to achieve precise correspondance between the sound and the picture frames.

In motion picture sound film the continuous sequence of longitudinally separated picture frames is disposed intermediate the lateral sides of the film. A multiplicity of longitudinally spaced drive sprocket openings are formed in the film between the picture frames and one lateral side of the film, and a magnetic sound stripe is provided between the picture frames and the opposite lateral side of the film.

However, in motion picture sound cameras and corresponding sound projectors the magnetic sound pickup head is spaced longitudinally from the picture frame diaphragm opening. Accordingly, the sound recordings on the magnetic stripe are displaced longitudinally from the picture frames to which they relate.

In conventional editing and splicing, the film is cut transversely completely through on a single transverse line. Therefore, the picture frame and sound recording immediately adjacent the transverse cut are not related, and this lack of correspondence between sound and picture is disturbingly noticeable, particularly when the visible action includes speaking, since movement of the lips do not correspond with the sound playback.

The only known procedure attempted heretofore to provide exact correspondence between sound and picture frames of motion picture sound film, involves the steps, following conventional splicing described hereinbefore, of utilizing the end portion of the sound track from the edited portion of film to replace, by re-recording, that other end portion of the sound track on the spliced film that does not relate to any of the picture frames in the spliced film. This re-recording of sound involves very complex and costly equipment, and hence is impracticable for use by anyone other than large studios.

SUMMARY OF THE INVENTION

In its basic concept, the present invention involves the cutting of motion picture sound film transversely between adjacent picture frames,, thence longitudinally between the picture frames and sound stripe and thence transversely across the sound stripe at a point at which the recorded sound relates to the picture frame immediately adjacent the transverse cut. Then, by making a second identical cutting at the opposite end of a portion of film to be removed, the mating ends of the film portions to be rejoined have exactly relating picture and sound.

It is by virtue of the foregoing basic concept that the principal objective of this invention is achieved; namely, to overcome the aforementioned disadvantages and limitations associated with prior splicing methods and apparatus.

Another important objective of this invention is the provision of method by which the splicing of motion picture sound film is achieved with speed and precision.

The foregoing and other objects and advantages of this invention will appear from the following detailed description, taken in connection with the accompanying drawings of a preferred embodiment.

DESCRIPTION OF THE PREFERRED EMBODIMENT

Figures 1, 2, 3, 4, 5:
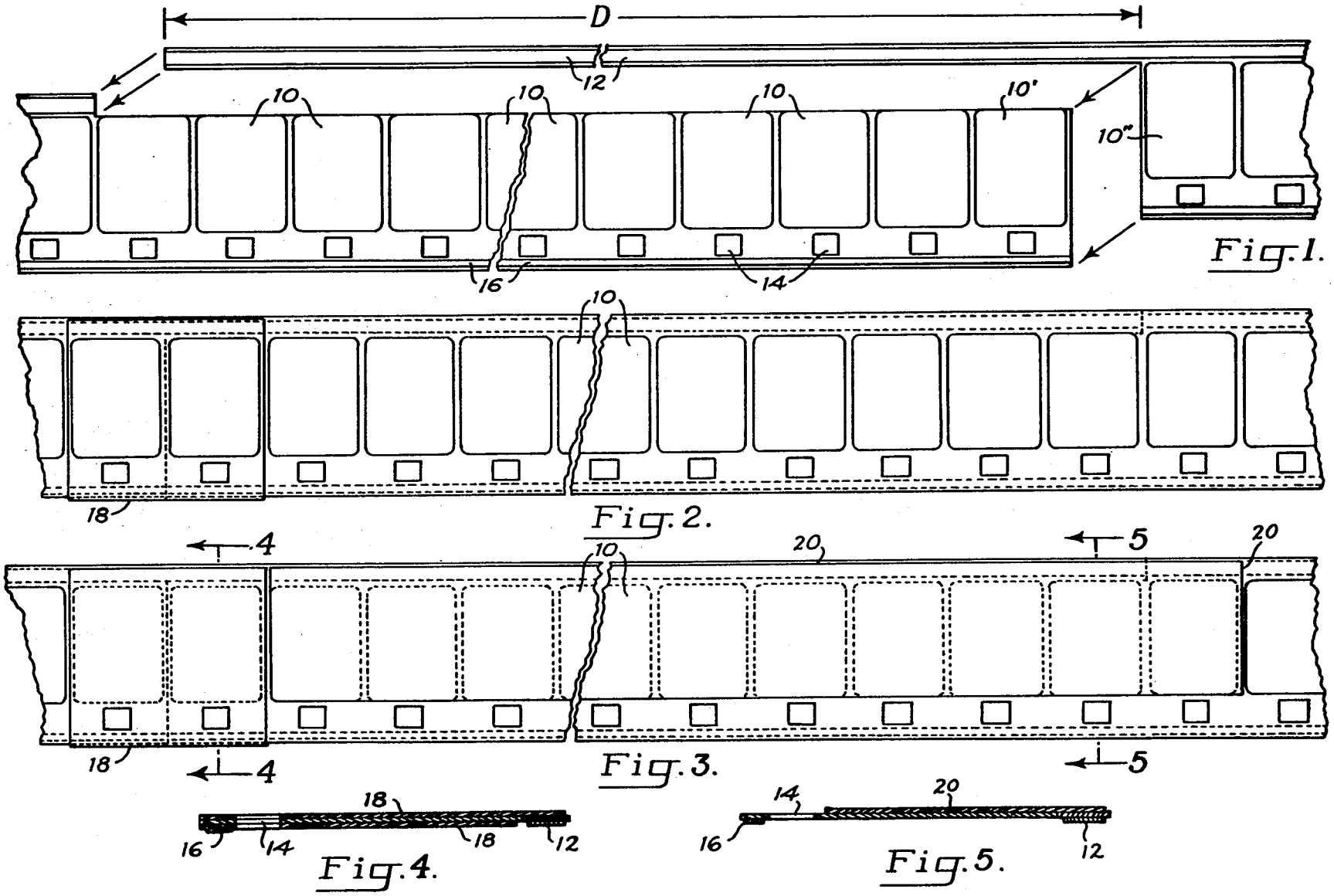
FIGS. 1, 2 and 3 are fragmentary, foreshortened plan views illustrating the fundamental sequence of steps involved in the method of this invention.
FIG. 4 is a view in transverse section taken on the line 4—4 in FIG. 3.
FIG. 5 is a view in transverse section taken on the line 5—5 in FIG. 3.
Figure 9:
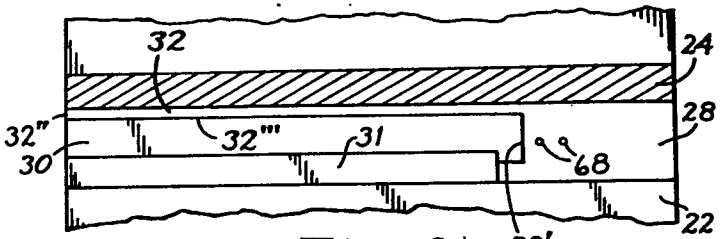
FIG. 9 is a fragmentary sectional view taken on the line 9—9 in FIG. 6.
Figure 7:
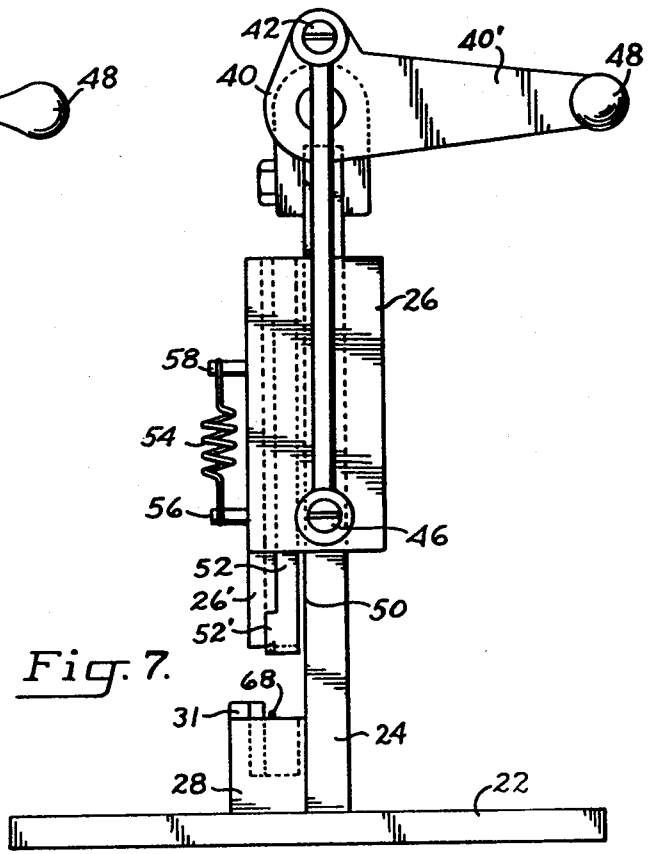
FIG. 7 is a side elevation as viewed from the right in FIG. 6.
Figure 8:
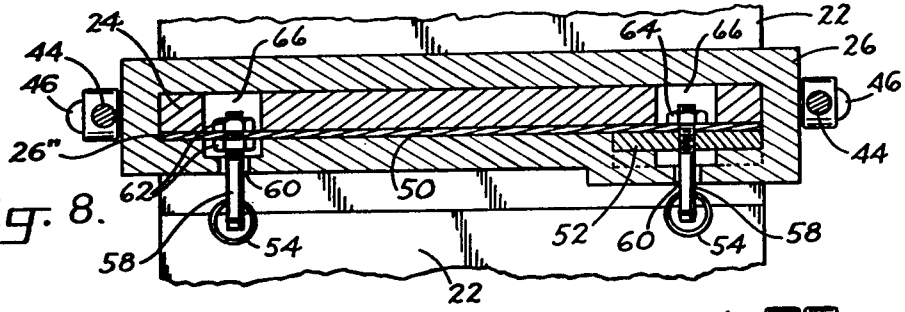
FIG. 8 is a fragmentary horizontal section taken on the line 8—8 in FIG. 6.
Figure 6:
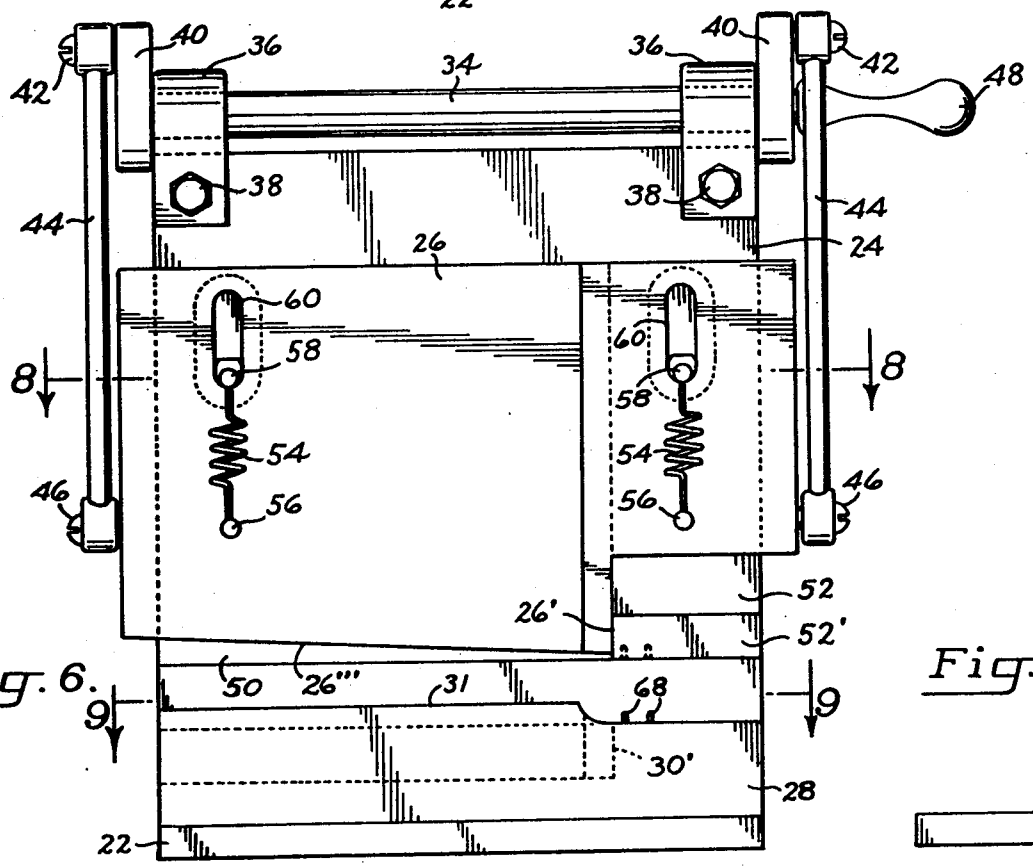
FIG. 6 is a front elevation of a motion picture sound film cutter embodying features of this invention.

Referring first primarily to FIGS. 1–5 of the drawings, the method of this invention first will be described. For this purpose let it be assumed that the film illustrated in the drawings is conventional super 8 motion picture sound film. In this film the sequence of longitudinally spaced picture frames 10 extend along the central portion of the film. Between one lateral side of the picture frames and the adjacent edge of the film is provided a stripe 12 of magnetic material upon which to record the sounds associated with the picture frames. Between the opposite side edge of the picture frames and the adjacent side edge of the film is provided a multiplicity of longitudinally spaced openings 14 arranged to receive the teeth of a drive sprocket assembly, which is provided in the camera and also in the projector, for moving the film through the camera and projector. Between the sprocket openings and the adjacent side edge of the film there generally is provided a stripe 16 of magnetic material. This strips of magnetic material generally is employed merely to provide a thickness matching the thickness of the sound stripe 12, and thus insure uniform winding of the film onto film reels.

It is characteristic of super 8 motion picture sound film that the sound recording and playback heads of the camera and projector, respectively, are displaced downstream from the picture taking and picture viewing diaphragm of such equipment, by a distance D (FIG. 1) of 3 inches, or 18 picture frames. Thus, with reference to FIG. 1 of the drawings, the picture frame 10' at the right hand end of the left hand film portion relates to the sound recorded at the right hand end of the sound stripe on said film portion. Similarly, the picture frame 10" located at the left hand end of the right hand film portion is related to the sound recorded at the left hand end of the sound stripe also attached to said film portion.

The first step of the method of this invention thus involves cutting of the motion picture sound film transversely between the adjacent picture frames 10' and 10" inwardly from the side edge of the film opposite the sound stripe 12 to a point closely adjacent but inwardly of the sound stripe.

The film then is cut longitudinally in the forward direction, i.e. toward the left in FIG. 1, between the row of picture frames 10 and the sound stripe 12, for a distance D of eighteen picture frames. The film then is cut transversely through the sound stripe.

Since the splicing of film is the result of editing the film to remove undesired portions, the foregoing cutting is repeated at the opposite end of a length of film which is desired to be removed.

Thus, as illustrated in FIG. 1, and assuming the undesired length of film has been removed, the end portions of the films which are desired to be spliced together form mating edges which are brought together in the manner illustrated by the arrows, and the two portions of film secured together, in the preferred manner presently to be described. With the film ends thus joined together, the picture frames and sound recordings are matched exactly.

The joining of the two end portions of film illustrated in FIG. 1 preferably is achieved in the manner illustrated in FIGS. 2 and 3. First, the film portions are inverted, end for end, to place the back face of the film upwardly, i.e. the face of the film opposite the sound stripe 12. This preferably is done on a conventional splicer, as described hereinafter, whereby a length of transparent tape 18, coated on one side with a transparent pressure sensitive adhesive, is applied transversely of the film, bridging the transverse cut and the adjacent picture frames, 10' and 10", as illustrated in FIG. 2. The length of the transparent tape is sufficient to be bent around the edge of the film opposite the sound stripe 12 and to overlie the picture frames on the front face of the film. However, as best shown in FIG. 4, the transverse tape terminates inwardly of the sound stripe 12 on the front face of the film, so as not to interfere with sound reproduction.

The application of the transverse length of transparent tape 18 is the same as in conventional splicing technique, and serves to provide a strong bridge across the transverse cut. The tape overlying the drive sprocket openings is cut away to expose the openings, as will be understood.

Next, referring to FIG. 3 of the drawings, a length of transparent tape 20 is applied to the back face of the film to bridge the longitudinal cut between the sound stripe 12 of the one portion of the film and the picture frames of the other portion. It will be observed that the width of this length of tape 20 is narrowed so as not to cover the drive sprocket openings 14, and its length is sufficient to extend from the edge of the transverse tape 18 to one picture frame beyond the transverse cut through the sound stripe. Thus, since the transparent tapes 18 and 20 terminate at their edges outside the picture frames, no disturbing or other undersirable lines appear in the projection of the film. Apparatus by which the method of this invention may be performed, now will be described.

Referring first to FIGS. 6–9 of the drawings, there is illustrated a cutter by which to perform the cutting operation described hereinbefore. The cutter includes a base plate 22 upon which is mounted an upstanding guide plate 24 which slidably receives and guides a cutter member 26 for vertical reciprocation relative thereto. For this purpose the cutter member is provided with a vertically elongated rectangular opening dimensions to receive the guide plate freely therethrough.

The cutter member cooperates with an anvil also mounted on the base plate. The anvil is a metal block 28 provided with a recess 20 in its top surface, extending to the left end thereof (FIG. 6) for receiving therein the lower cutting edge of the cutter member.

It is to be noted that a portion of the recess 30 in the anvil block is widened slightly at the right hand end and that the cutter member also is widened correspondingly. The transverse cutting edge 26' of the cutter member and cooperating edge 30' of the recess thus is extended slightly beyond the edge of the film so as to insure complete cutting from the edge adjacent the drive sprocket openings inwardly to a point adjacent the sound stripe. The transverse cutting edge 26" which effects cutting through the sound stripe, is provided by the left hand edge of the rectangular opening within the cutter member, as it passes downward along the left hand edge 32" of the rearward face 32 of the anvil.

Vertical reciprocation of the cutter member relative to the guide plate is provided by a lever assembly which pivotally interconnects the guide plate and cutter member. Thus, a shaft 34 is journaled for rotation in a pair of spaced bearings 36 secured to the upper end of the guide plate, as by means of screws 38. To each of the opposite ends of the shaft is secured a cam member 40. Secured eccentrically to each of the cam members, by means of a pivot screw 42, is one end of an elongated rod 44. The opposite end of each rod is secured pivotally, by means of a pivot screw 46, to the adjacent side of the cutter member. One of the cam members is provided with a lever extension 40' fitted at its outer end with a handle 48 by means of which to manipulate the lever assembly and reciprocate the cutter member relative to the anvil.

Associated with the cutter member 26 is a hold down member which serves to hold the motion picture sound film firmly on the anvil during the cutting operation performed by the cutter member. As illustrated, the hold down member includes a pair of plates 50 and 52 of which plate 50 extends the full width of the internal rectangular opening in the cutter member 26 and serves to hold down against the inner flat surface 32 of the anvil the sound stripe 12 of the film. The second plate 52 is bonded integrally to the first plate, at the right hand side of the latter (FIGS. 6 and 8) on the front side thereof, and fits slidably within a forwardly offset portion of the rectangular opening in the cutter member. This hold down plate 52 projects downward to the same bottom edge as the first named plate 50 and is widened in its lower area, at 52'. This widened plate area 52' serves to hold down the portion of the film immediately adjacent the transverse cut to be provided between adjacent picture frames.

The lower right hand corner of the cutter member 26 is cut away to accommodate relative movement between the cutter member and hold down plate.

The integrated hold down plates and the cutter member are interconnected in such manner that they both move vertically, by manipulation of the hand lever 40', until the hold down plates are brought into abutment with film disposed on the surface of the anvil. Then, further counterclockwise rotation of the hand lever effects further downward movement of the cutter member. The cutting edges at the lower end of the cutter member thus move downward in shearing proximity to the cooperating edges of the anvil, to effect cutting of the film. In the embodiment illustrated, this cutting of the film proceeds progressively, first by making the transverse cut between adjacent picture frames, at edges 26' and 30', thence longitudinally between the picture frames and sound stripe, by virtue of the shearing angle provided the rear lateral cutting edge 26''' of the cutter member, cooperating with the rear cutting edge 32''' of the recess, and finally the transverse cut through the sound stripe, at cutting edge 26''.

The front side of recess 30 is defined by a raised fence 31 the inner side of which is spaced from the confronting side of guide plate 24 a distance equal to the width of the motion picture sound film to be spliced. The film thus is confined against lateral displacement, whereby to insure precise longitudinal cutting parallel to the sound stripe 12.

The interconnection between the cutter member and hold down member preferably includes resilient means by which the hold down member is urged resiliently downward to maintain positive contact with the underlying film during further downward progress of the cutter member relative to the anvil. Then, when the hand lever is rotated clockwise to raise the cutter member upward away from the anvil, upon completion of the cutting operation, the hold down member is caused to follow upwardly.

In the embodiment illustrated, this resilient interconnection is provided by a pair of coil springs 54. The lower end of each coil spring is connected to a pin 56 projecting forwardly from the front surface of the cutter member. The upper end of each coil spring is connected to a pin 58 which is secured to the hold down plate and projects forwardly freely through a vertically elongated slot 60 in the cutter member. The vertically elongated slots are so arranged that when the upper pins abut the lower ends of the slots, the bottom edge of the hold down plates are just slightly below the lowermost cutting edge of the cutter member. This insures that the hold down member first engages the film and secures it in position, prior to commencement of the cutting operation.

The left hand pin 58 (FIG. 8) is secured to the hold down plate by means of the spaced nuts 62 received on the inner threaded portion of the pin, and the right hand pin 58 is secured to the hold down plates by reception of the threaded inner portion of the pin in a threaded opening in the plates, together with the locking nut 64. Access to the nuts is made available by elongated slots 66 in the guide plate.

Means is provided for orienting the film properly with respect to the cutter member and anvil so that the transverse cut is made precisely between adjacent picture frames. For this purpose, at least one, and preferably a pair of upstanding registration pins 68 are provided on the anvil adjacent the right hand end 30' of the recess. These registration pins are arranged to receive thereover a pair of the drive sprocket openings 14 in the film, as will be understood.

Figure 10:
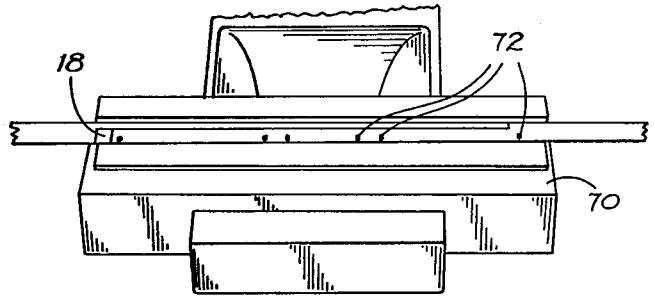
FIG. 10 is a fragmentary perspective view of a conventional film splicer forming a component part of the apparatus of this invention for performing the method of this invention.

As previously explained, when the film has been cut at longitudinally spaced intervals to remove an undesired section, the mating end portions of the film to be joined are brought into mutual edge abutment and the transverse strip 18 of transparent tape applied, as illustrated in FIG. 2. The application of this tape is facilitated by the use of a conventional splicer, the deck portion 70 of which is illustrated in FIG. 10. As is well known, the splicer includes a mounting (not shown) for the roll of transparent tape which may be drawn forwardly along the center line of the splicer to overlie and bridge the abutting edges of portions of film supported on the splicer deck and oriented by the registration pins 72. The splicer also includes cutting mechanism (not shown) by which to cut the transparent tape.

With the transverse strip of transparent tape 18 thus applied across the transverse cut, as in FIG. 2, the partially joined portions of film are moved toward the left to the position illustrated in FIG. 10, wherein the transverse tape 18 is located adjacent the left hand side of the splicer. In this position the portions of film defined by the longitudinal cut between the picture frames and sound stripe, are supported on the splicer, as in FIG. 10. In this position, a length of transparent tape is applied to bridge the longitudinal cut, as well as the transverse cut through the sound stripe at the right side of the splicer.

Means is provided for facilitating the application of the transparent tape across the longitudinal cut. This means comprises a holder by which a length of transparent tape is supported in registry with the longitudinal cut.

Figure 11:
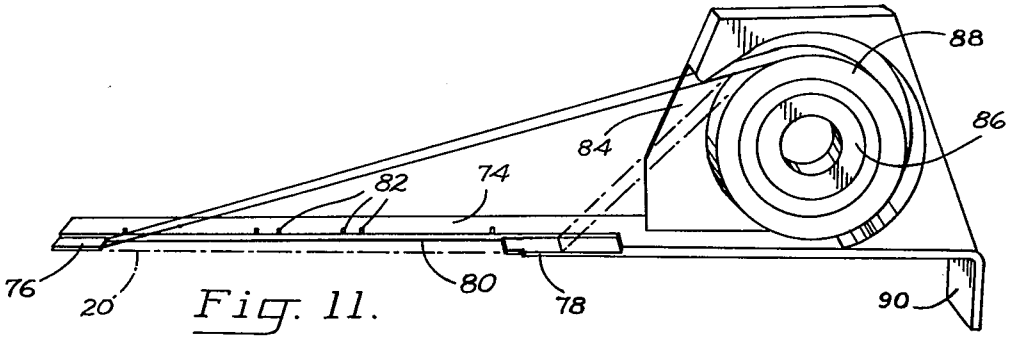
FIG. 11 is a perspective view of a transparent tape holder component of the apparatus of this invention.

Referring to FIG. 11 of the drawings, the tape holder comprises an elongated flat plate 74 which is cut away intermediate its ends to form a notch. The portions of the plate defining the opposite ends of the notch are reduced in thickness and provide attachment pads 76 and 78 for temporarily securing the opposite ends of a length of transparent tape 20, with the intermediate portion of the tape spanning the notch.

Adjacent the edge 80 of the plate defining the inner side of the notch is provided a plurality of openings 82 spaced apart to match the position and spacing of the registration pins 72 on the splicer. By this means the notch is oriented relative in the longitudinal cut between the film portions, by installing the registration pins 72 in the openings 80 in the plate.

In the preferred embodiment illustrated, the plate 74 is extended longitudinally at one end of the notch and provided with an upstanding wall 84. A hollow shift 86 projects perpendicularly from the wall and serves to mount the hollow core of a roll 88 of transparent, pressure sensitive tape. It is to be noted that the upstanding wall is positioned so that the mounted roll of tape is in alignment with the attachment pads and notch.

Also, the end of the plate 74 on which the upstanding wall is mounted is turned downwardly at right angles to the plate, to provide a supporting foot 90 which is of the same height as the film supporting deck 70 of the splicer. The portion of the plate overlying the splicer thus extends parallel to the splicer deck.

FIG. 11 illustrates the manner in which a length of transparent tape is secured to the pads 76, 78 and thus spans the notch therebetween. The transparent tape is drawn from the roll 88 and its terminal end applied to the pad 76 at the terminal end of the plate, at the left hand end in FIG. 11. Finger pressure then is applied downward on an intermediate portion of the tape overlying the opposite pad 78, thus bringing the tape into adhesive contact with the pad, in the manner illustrated in broken lines in FIG. 11.

Figure 12:
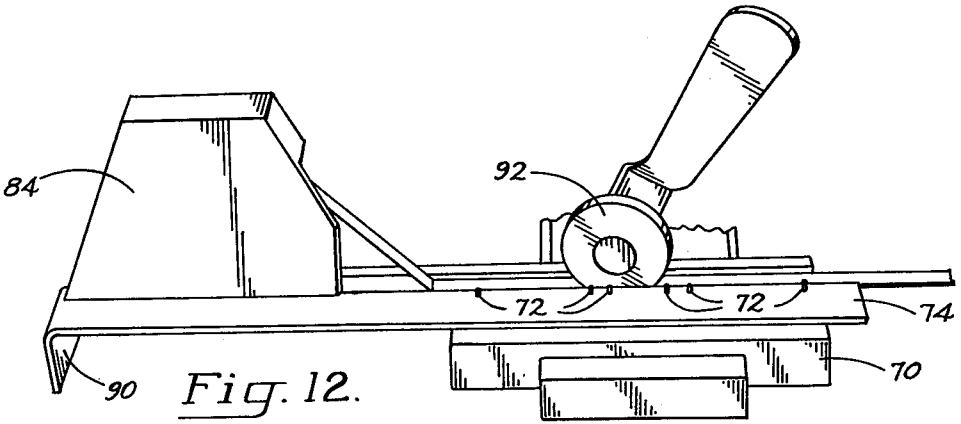
FIG. 12 is a fragmentary plan view illustrating the cooperative arrangement of the splicer of FIG. 10 and tape holder of FIG. 11 for the application of transparent tape in making a film splice.

With a length of tape thus bridging the notch between the pads, the holder is turned about, 180° in the plane of the drawing, and mounted on the deck of the splicer, with the registration pins 72 received in the matching openings 82 in the holder plate, as illustrated in FIG. 12.

The length of transparent tape thus spanning the notch between the mounting pads, also overlies the longitudinal cut between the portions of film mounted on the splicer in the position of FIG. 10. Furthermore, the length of transparent tape spanning the notch is oriented precisely in the position of tape 20 illustrated in FIG. 3 of the drawing; namely, it extends from the transverse transparent tape 18 toward the right, terminating one picture frame beyond the transverse cut across the sound stripe 12 and located inwardly of the drive sprocket openings 14.

With the length of transparent tape thus accurately oriented over the portions of film to be joined, the rubber wheel 92 of a hand operated pressure roller is rolled lengthwise over the transparent tape to bring it into contact with the underlying portions of film.

Figure 13:
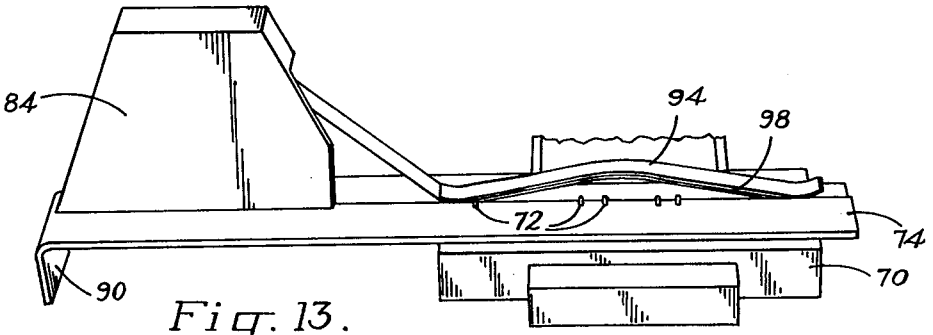
FIG. 13 is a fragmentary perpective view of the splicer of FIG. 10 and tape holder of FIG. 11 in association with a tape cutter knife, for cutting from the spool of transparent tape the length of tape applied to the film in FIG. 12.
Figure 14:
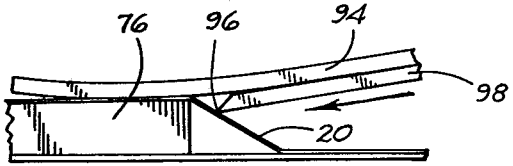
FIG. 14 is a fragmentary view in side elevation, and on a magnified scale, illustrating the cooperative relationship of the cutter knife of FIG. 13 and the tape holder of FIG. 11, in cutting the length of transparent tape.

The tape then is cut at the opposite ends of the notch, to allow removal of the holder. For this purpose, there preferably is provided a special knife by which the tape may be cut without accidentally cutting or otherwise damaging the underlying film. The knife is illustrated in FIGS. 13 and 14, and it is formed of a narrow strip 94 of spring metal or other resilient material which is bent intermediate its ends to the general shape of an archery bow, i.e. to form an included obtuse angle intermediate its ends. The terminal end portions of the strip are bent slightly upward, as illustrated for bearing on the pads 76, 78 during the cutting operation.

To the included angle side of the resilient strip there is secured means providing a pair of sharp knife edges 96 (FIG. 14) each of which faces its corresponding end of the strip. In the embodiment illustrated, the pair of knife edges is provided by a single length of metal 98 bent to the same shape as the strip and secured to the included angle side thereof.

In the relaxed, bent condition of the knife illustrated in FIG. 13, the distance between the pair of knife edges 96 is slightly less than the distance between the inner edges of the tape support pads 76, 78. Thus, the knife may be positioned with its terminal end portions resting upon the tape overlying the pads, with the knife edges spaced inwardly thereof. Then, upon the application of downward hand pressure on the intermediate portion of the bent knife, the knife edges are moved outwardly toward the inner edges of the pads. The interposed transparent tape 20 thus is cut by each knife edge as the tape is pressed between the knife edge and the adjacent edge of the pad.

After the tape has been cut at its opposite ends of the notch by the operation of the knife, the knife and tape holder are removed and the rubber wheeled roller 92 once again applied to the terminal end portions of the tape immediately adjacent the edges cut by the knife, to insure that the full length of transparent tape 20 is bonded to the underlying portions of film.

From the foregoing, it will be appreciated that the present invention provides for the splicing of motion picture sound film with speed and precision in such manner that the sound is related precisely to each picture frame. The novel method is performed by apparatus of the invention which is of simplified construction for economical manufacture and thus is available for use by everyone.

It will be apparent to those skilled in the art that various changes may be made in the size, shape, type, number and arrangement of parts described hereinbefore, as well as variations in the method steps also described. For example, in the event the second magnetic stripe 16 at the side of the film opposite sound stripe 12 also is used for recording sound, or for any other purpose which is related to the picture frames, the transverse cut between adjacent picture frames may be made without cutting across the second magnetic strip 16 at the same position, and the film may be cut longitudinally between the second magnetic stripe and the drive sprocket perforations 14, in the same manner as the longitudinal cutting of the sound stripe described hereinbefore. These and other modifications in the method and apparatus may be made without departing from the spirit of this invention.

Having now described my invention and the manner in which it may be used, I claim:

1. The method of splicing motion picture sound film wherein the sound recorded on the sound stripe is displaced longitudinally of the related picture frame by several frames, the method comprising:

(a) cutting the film transversely between adjacent picture frames but not across the sound stripe, thence longitudinally from said transverse cut between the picture frames and the sound stripe to a point at which the sound relates to the first picture frame adjacent said transverse cut, thence transversely across said sound stripe, (b) repeating said cutting operation at another location on the film for removing a portion of the film, whereby one of the mating ends of the film to be joined has a length of sound stripe extending longitudinally from an end picture frame and the other of the mating ends of the film to be joined has a length of several picture frames extending longitudinally from the sound stripe the same distance as the longitudinally extending sound stripe on the said one end of film, (c) placing the edges of said mating ends of film in mutual abutment, and (d) securing said abutment mating ends together.

2. The method of claim 1 wherein the sound stripe extends along one longitudinal side of the film and the transverse cutting between adjacent picture frames extends inwardly from the film edge opposite said sound stripe.

3. The method of claim 1 wherein the sound stripe extends along one longitudinal side of the film and said securing together of the mating ends comprises applying transparent tape to the film to bridge the abutting mating edges of the film.

4. The method of claim 1 wherein the sound stripe extends along one longitudinal side of one face of the film and said securing together of the mating ends comprises applying a first transparent tape to the film to bridge the abutting transverse edges of film between picture frames, and applying a second transparent tape to the film to bridge the abutting longitudinal edges of the film between the picture frames and sound stripe, on the face of the film opposite the sound stripe.

5. The method of claim 4 wherein the film includes longitudinally spaced drive sprocket openings along the side opposite the sound stripe and the second tape is applied inwardly of the drive sprocket openings.

* * * * *